United States Patent [19]

Lamirand et al.

[11] Patent Number: 5,045,343

[45] Date of Patent: Sep. 3, 1991

[54] ELECTROSTATICALLY DIRECTING AND DEPOSITING

[75] Inventors: Joseph B. Lamirand, Muncie, Ind.; Dwight B. Raddatz, Woodridge, Ill.

[73] Assignee: Ball Corporation, Muncie, Ind.

[21] Appl. No.: 457,011

[22] Filed: Dec. 26, 1989

[51] Int. Cl.[5] ..... B05D 1/04; B05D 5/10

[52] U.S. Cl. ..... 427/33; 118/634

[58] Field of Search ..... 427/25, 27, 32, 33; 118/622, 630, 634

[56] References Cited

U.S. PATENT DOCUMENTS 2,710,589 6/1955 Brunner ..... 427/32 X 4,839,202 6/1989 Grassel et al. ..... 427/424

*Primary Examiner*—Evan Lawrence

*Attorney, Agent, or Firm*—Gilbert E. Alberding

[57] ABSTRACT

Apparatus (74) and method are provided for electrostatically depositing particles (64) of a first material onto a sheet (18) of a second material. The apparatus (74) includes an accelerating and directing passageway (96) that is formed by a deflector (82) and one end (54) of a depositing chamber (78), and an accelerating electrode (90) that is disposed in the passageway (96). The accelerating electrode (90) and the passageway (96) cooperate to accelerate particles (64) in the depositing chamber (78) and to direct them into electrostatic depositing contact with the sheet (18).

17 Claims, 3 Drawing Sheets

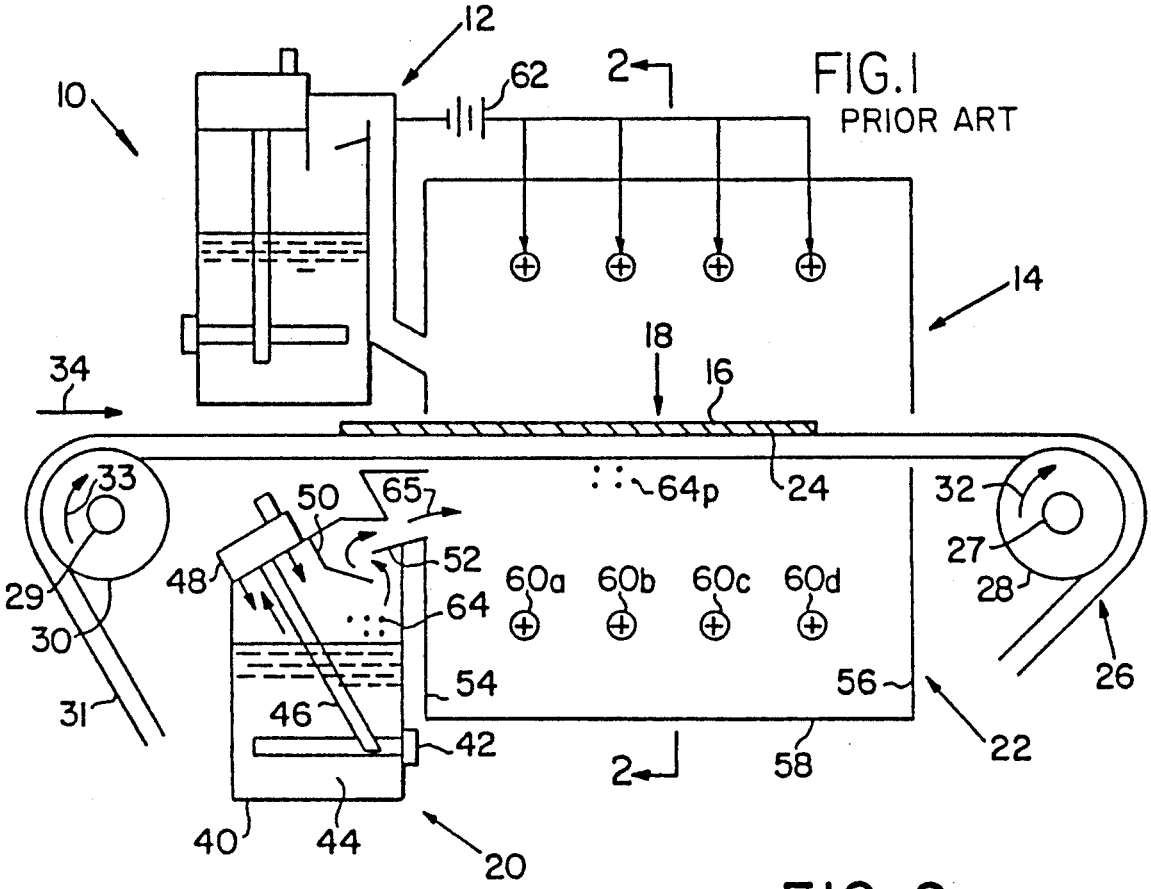
FIG. 1
PRIOR ART
FIG. 2
PRIOR ART
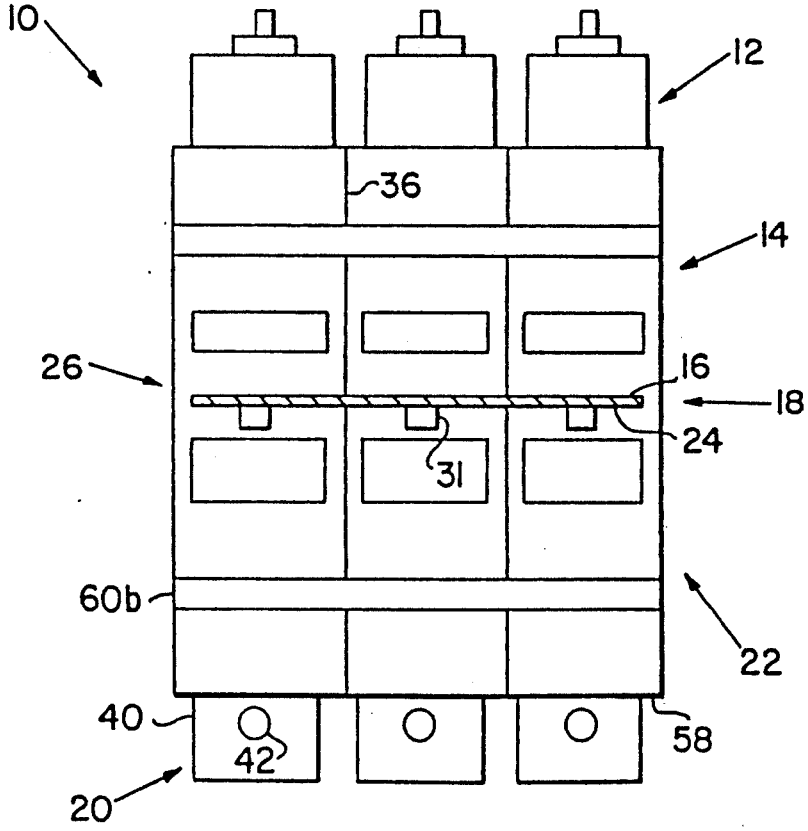

ELECTROSTATICALLY DIRECTING AND DEPOSITING

BACKGROUND OF THE INVENTION

1. Field of the Invention

The present invention relates to electrostatic depositing. More particularly, the present invention pertains to a depositing apparatus with an accelerating electrode and a directing passageway that cooperate to accelerate entrance of particles of lubricant into the passageway and to direct the particles into electrostatic contact and adherence with the work piece.

2. Description of the Related Art

The process of electrostatic depositing is used for depositing various kinds of materials onto metal objects or sheets. Uses for electrostati depositing include depositing of: paint, dry powder coatings, abrasives, flocking materials, and lubricants. In addition, electrostatic depositing is used to reproduce printed material and pictures by the process that is known as xerography.

Examples of the related art in depositing of lubricants are: Scholes et al., U.S. Pat. No. 4,066,803, issued Jan. 3, 1978; and Jenkins et al., U.S. Pat. No. 2,608,176, issued Mar. 16, 1948. In like manner, Escallon, U.S. Pat. No. 4,526,804, issued July 2, 1985, and Rocks et al., U.S. Pat. No. 3,155,545, issued Feb. 27, 1961, are examples of the related art in depositing granular materials; whereas Wiggins, U.S. Pat. No. 3,937,180, issued Feb. 10, 1976, and Cosentino et al., U.S. Pat. No. 4,724,154, issued Feb. 9, 1988, are examples of patents which teach electrostatic depositing of paint.

Two problems have attended electrostatic depositing. One is that the process of electrostatic depositing can develop a residual electrostatic potential on the coated material. Where materials with dielectric properties, such as lubricants, are deposited, the deposited material can retain a residual electrostatic charge. In the case of electrostatically lubricated metallic sheets, the residual electrostatic charge has caused sheets in a stack to stick together, and has electrostatically attracted contaminants from the air to lodge on the coated material.

The second problem is that of meeting increasingly strict ecological standards in that some of the coating material drifts out, or is blown out, of the depositing chamber.

A primary cause of the coating material drifting out of the depositing chamber is that, as the substrate becomes electrostatically coated, it can acquire the charge of the deposited material, reducing the electrical potential between the charged particles which are to be deposited and the substrate, and thereby allowing charged particles to drift out of the depositing chamber rather than being attracted to the depositing surface.

It has been found that, even though a metallic sheet or coil of metallic material is exposed to contact with the transporting apparatus, the surface of the sheet or coil can retain an electrical potential sufficient to spark to a metallic object that is spaced from the coated sheet or coil. This is particularly true of sheets.

The related art includes some attempts to correct the problem of a residual electrostatic charge. For instance, Gibbons et al., U.S. Pat. No. 3,702,258, issued Nov. 7, 1972, teach a method for neutralizing the residual electrostatic charge that remains after treating a web with an alternating current corona field to increase its printability. The apparatus of Gibbons et al. includes a positively energized roller and a negatively energized roller which contact the web, and a pair of electrodes that are spaced apart from respective ones of the rollers on opposite sides of the web from that of the rollers, and that are connected to a potential that is intermediate of the potentials of the two rollers.

Also, in U.S. Pat. No. 4,517,143, issued May 14, 1985, Kisler teaches passing a randomly charged web through two oppositely-charged electrostatic fields to adjust the electrostatic field charge level to a desired, and uniform, level.

SUMMARY OF THE INVENTION

In the present invention, a deflector cooperates with one end of the depositing chamber to form an accelerating and directing passageway. An accelerating electrode, that is disposed in the passageway, cooperates with the passageway to accelerate entrance of particles into the depositing chamber and to direct them into electrostatic contact and adherence with a work piece.

More particularly, particles of a lubricant are aspirated by a particle generator, the aspirated particles of lubricant are directed into a first end of a depositing chamber and flow into the depositing chamber intermediate of the first end and a deflector that is disposed in the depositing chamber.

At least one depositing electrode is disposed in the depositing chamber intermediate of the deflector and a second end of the depositing chamber, and is disposed at a first distance from a work path along which work pieces are transported through the depositing chamber; whereas the accelerating electrode is disposed closer to the work path than is the depositing electrode.

In operation, both the accelerating electrode and the depositing electrode are energized at a first polarity, generally a positive polarity, which is opposite to the polarity of the work piece.

As the particles of lubricant are aspirated, they are attracted and drawn into the depositing chamber by the electrical potential on the accelerating electrode, are directed toward the accelerating electrode, are charged to the polarity of the accelerating electrode, and are directed toward the work piece by an accelerating and directing passageway that includes a deflector.

The air which is used for aspirating the particles of lubricant, even though it is only in the order of 1.3 cubic feet per minute, causes some of the smaller of the particles to drift past the deflector and toward the second end of the depositing chamber.

In one embodiment, the direction of transport of the work pieces is reversed so that the work pieces enter the depositing chamber from the second end thereof, causing the smaller particles, which have drifted past the deflector and toward the second end of the depositing chamber, to be deposited first.

The advantage of depositing the smaller particles first is that the larger particles are able to accept a relatively-large electrical charge, and so are more easily drawn into depositing contact with the work piece as the work piece is transported through the depositing chamber, thereby accumulating a positive charge as charged particles are deposited thereupon. Thus, more complete depositing of the particles is accomplished both by the directing of the particles by the deflector and the accelerating electrode, and by reversing the direction of transport.

In another embodiment, the residual electrostatic charge of the coated work piece is electrostatically neutralized. Electrostatic neutralization is achieved by the use of a neutralizing electrode that is disposed in the depositing chamber, or in a separate neutralizing chamber, and by energizing the neutralizing electrode to the opposite polarity from that of the accelerating and depositing electrodes.

The use of a neutralizing electrode, in addition to drastically reducing the residual electrostatic charge on the work piece, results in more complete depositing of the lubricant, because particles that are charged to the opposite polarity are strongly attracted to a work piece that has built up an electrostatic charge that is of the first polarity.

In a first aspect of the invention, a deflector is disposed near the end of the depositing chamber that receives the aspirated particles of lubricant, and an accelerating electrode is disposed intermediate of the first end of the depositing electrode and the deflector.

In a second aspect of the invention, the depositing chamber is further divided by insertion of a baffle that divides the depositing chamber into separate chambers for depositing and neutralizing; and a neutralizing electrode is disposed in the neutralizing chamber.

In a third aspect of the invention, the direction of transport is reversed so that the smaller of the particles, which tend to drift from the end wherein they are injected to the opposite end, are deposited first.

BRIEF DESCRIPTION OF THE DRAWINGS

FIG. 1 is a longitudinal cross-sectional elevation of a prior art apparatus for electrostatically depositing lubricant onto sheets of metallic material, and includes one depositing chamber for electrostatically coating the top surface of a metallic sheet and another depositing chamber for electrostatically coating the bottom surface of the metallic sheet;

FIG. 2 is a transverse cross-sectional elevation of the prior art apparatus of FIG. 1, taken substantially as shown by section line 2—2 of FIG. 1;

DESCRIPTION OF THE PREFERRED EMBODIMENTS

Figure 3:
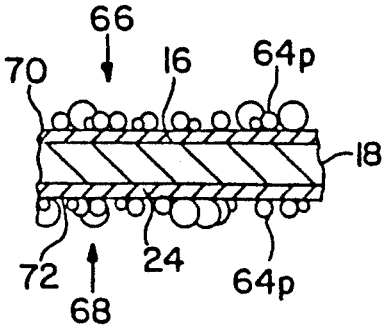
FIG. 3 PRIOR ART
FIG. 3 is an enlarged cross section of a portion of a sheet of material which has been coated on both sides with a coating such as a paint, and which has been electrostatically coated subsequently with spheres of a lubricant.

Referring now to the drawings, and more particularly to FIGS. 1 and 2, the prior art device shown in FIGS. 1 and 2 corresponds generally to the apparatus of Scholes et. al., U.S. Pat., No. 4,066,803, and FIG. 1 corresponds more particularly to FIG. 9 of the aforesaid patent.

Continuing to refer to the prior art apparatus as shown in FIGS. 1 and 2, an electrostatic depositing apparatus 10 includes a first particle generator 12 and a first depositing chamber 14 for depositing lubricant onto a top surface 16 of a work piece, or sheet, 18 of metallic material. In like manner, the electrostatic depositing apparatus 10 includes a second particle generator 20 and a second depositing chamber 22 for depositing lubricant onto a bottom surface 24 of the sheet 18 of material.

The electrostatic depositing apparatus 10 also includes a transporting mechanism 26 which transports the sheets 18 through, or between, the depositing chambers, 14 and 22. The transporting mechanism 26 includes a drive shaft 27 onto which are mounted drive pulleys 28, a driven shaft 29 upon which are mounted driven pulleys 30, and conveyor belts 31 which interconnect the drive pulleys 28 and the driven pulleys 30. The direction of rotation of the pulleys 28 and 30 are indicated by arrows 32 and 33; and the direction of transport of the sheet 18 is indicated by an arrow 34.

The aforesaid patent of Scholes et. al. shows and describes the mechanism, and the mechanical details, for transporting the sheets 18, whereas the present invention does not involve these mechanical details. Therefore, it is unnecessary to describe these mechanical details herein. For instance, Scholes et. al. show and describe the use of a plurality of drive pulleys, a plurality of driven pulleys, and a plurality of belts to transport a sheet 18 through their depositing chambers.

Further, Scholes et al. show and describe the use of a plurality of particle generators, 12 and 20, each providing a mist of lubricant for a portion of the width of the sheet 18, and they show and describe the use of longitudinally-disposed partitions 36 for dividing the depositing chamber into a plurality of depositing chambers 14 and 22. Each of the particle generators, 12 and 20, provide aspirated lubricant for one of the depositing chambers 14 and 22.

Further, even though the particle generators, 12 and 20, are somewhat different in appearance, their function is the same. Therefore, Applicant will describe only the portion of the depositing apparatus 10 which deposits lubricant onto the bottom surface 24 of the sheets 18.

The particle generator 20 includes a reservoir 40, an electric heater 42 that is disposed in a pool 44 of lubricant, a suction tube 46 which is disposed in the pool 44 of lubricant, an aspirator 48, and particle-separation baffles, 50 and 52.

The depositing chamber 22 includes a first end 54, a second end 56, and a bottom cover 58. Depositing electrodes 60*a*, 60*b*, 60*c*, and 60*d* are transversely disposed in the depositing chamber 22, are equidistantly spaced from each other, and are energized to a positive polarity by a source of high voltage, symbolized as a battery 62. The positive polarity of the electrodes 60*a*–60*d* is indicated by the "+" signs in FIG. 1.

In operation, the pool 44 of lubricant in the reservoir 40 is kept in a liquid state by the heater 42; and lubricant is drawn up into the suction tube 46 by air being blown through a venturi, not shown, in the aspirator 48. The lubricant is then aspirated out of the aspirator 48 in droplets, or particles of lubricant 64, of various sizes. The largest ones of the particles 64, which comprise ninety percent of the total number of particles 64, drop back into the pool 44 of lubricant because they are unable to navigate a tortuous path, which is generally designated by arrows 65, and which is provided by the particle-separation baffles, 50 and 52.

In contrast to the largest of the particles 64, the remainder of the particles 64, which have diameters between one and ten microns, form a cloud of particles 64 which drifts through the particle-separation baffles, 50 and 52.

It is accurate to speak of the remainder of the particles 64 drifting through the particle-separation baffles, 50 and 52, because typically an air pressure of 10–30 pounds per square inch and an orifice diameter of 0.05 inches is used to aspirate the lubricant, producing an air flow in the neighborhood of merely 0.8 to 1.4 cubic feet per minute.

The air that is used by the particle generator 20 is sufficient to transport the smaller of the particles 64 toward the second end 56 of the depositing chamber 22. Therefore, it is also accurate to speak of the smaller of the particles 64 being transported from the first end 54 to the second end 56 of the depositing chamber 22. In like manner, since the supply of air to the particle generator 20 is so small, the air is unable to transport the larger of the particles toward the second end 56 of the chamber 22 before they are deposited; thus, it is accurate to speak of the smaller of the particles 64 being separated from the larger of the particles 64.

As the remainder of the particles 64 drift toward the depositing chamber 22, the electrodes, 60*a*–60*d*, which are energized by a voltage potential that is sufficient to produce a corona discharge, ionize the surrounding atmosphere, charging the atmosphere, and resulting in the formation of charged particles which collide with the particles 64 of lubricant, and charge the particles 64 within the depositing chamber 22 to the positive polarity.

The positively-charged particles are referred to hereafter as particles 64*p*.

The positively-charged particles 64*p* are attracted to the sheet 18 of metallic material which initially is at, or near, ground potential, as shown by the electrical schematic of FIG. 1.

Referring now to FIGS. 1 and 3, as the sheet 18 is transported through the depositing chamber 22 at a velocity upwardly of 300 feet per minute, and as particles 64*p* of lubricant are electrostatically deposited, the top and bottom surfaces, 16 and 24, of the sheet 18 start to build up a positive electrostatic charge.

Referring now to FIGS. 1–3, as the sheet 18 proceeds from the first end 54 to the second end 56 of the depositing chamber 22, and as the electrostatic depositing of the particles 64*p* continues progressively, a positive charge may build up to a potential which results in sparking from the metallic sheet 18 to a part of the apparatus, not shown, that is as much as twelve centimeters away from the sheet 18.

Referring now to FIG. 3, the sheet 18 has been coated previously with layers of paint, 70 and 72. The layers of paint may form an insulating coating that prevents grounding of the metal sheet and discharge of the charged lubricant particles. On top of these layers of paint, 70 and 72, are the coatings, 66 and 68, of lubricant. Since the layers of paint, 70 and 72, can isolate the charged lubricant particles from the metal sheet and from "ground", and since the areas of the surfaces, 16 and 24, of the sheet 18 are quite large, it is apparent that the painted and lubricated sheet 18 can develop a tremendously large electrical charge. Thus, with some sheets, a very large electrostatic charge can remain on the sheet 18, even though the sheet 18 is contacted by the apparatus, and it is likewise understandable that this large charge can cause problems.

As noted previously, problems which attend this electrostatic charging of the sheet 18 include: 1) lubricated sheets that tend to stick together; and 2) a build-up of electrostatic charge that decreases the attraction of positively-charged particles, so that an excessively large percentage of the particles 64*p* drift out of the depositing chamber 22.

Figure 4:
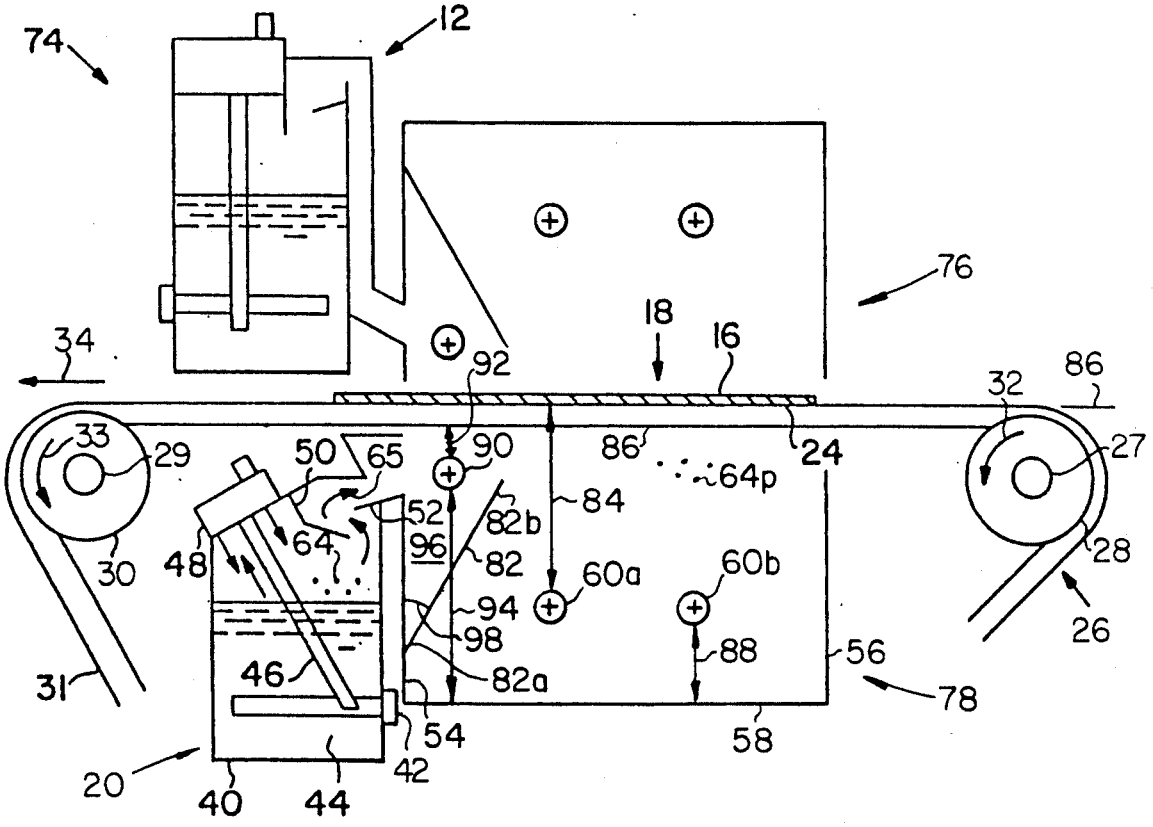
FIG. 4 is a cross-sectional elevation of a first embodiment of the present invention wherein a deflector is disposed in the depositing chamber, and an accelerating electrode is interposed intermediate of the first end of the depositing chamber and the deflector.

Referring now to FIG. 4 and to a first preferred embodiment therein, a depositing apparatus 74 includes the particle generators 12 and 20, depositing chambers 76 and 78, and the transporting mechanism 26 with all of the previously-recited parts thereof. The depositing chamber 78 includes the first end 54, the second end 56, and the bottom cover 58.

A deflector 82 is disposed in the depositing chamber 78 intermediate of the first end 54 and the second end 56; and electrodes 60*a* and 60*b* are disposed in the depositing chamber 78 intermediate of the deflector 82 and the second end 56, and are at a first distance 84 from a transporting path 86 and at a second distance 88 from the bottom cover 58. Deflector 82 includes an outer edge 82*a* and an inner edge 82*b* that is closer to the sheet 18 and to the second end 56, than is outer edge 82*a*.

An accelerating electrode 90 is disposed in the depositing chamber 78 intermediate of the first end 54 of the depositing chamber 78 and the deflector 82, at a third distance 92 from the transporting path 86 which is smaller than the first distance 84, and at a fourth distance 94 from the bottom cover 58 which is larger than the second distance 88.

Both the depositing electrodes, 60*a* and 60*b*, and the accelerating electrode 90 are energized to the positive polarity, as indicated by the "+" signs.

In operation, the work piece, or sheet 18 is transported through the depositing chamber 78 in the direction shown by the arrow 34, the particles 64 are injected into the depositing chamber 78 proximal to the first end 54 thereof, and the accelerating electrode 90, being of the positive polarity whereas the particles have no charge, accelerates the particles into an accelerating and directing passageway 96 that is formed by the first end 54 and the deflector 82. Then, as the particles 64 acquire a positive electrostatic charge, the electrostatic charge on the particles 64*p* cooperates with the deflector 82 to direct the positively-charged particles 64*p* into depositing contact with the sheet 18.

This directing of the particles 64 is further enhanced by the deflector 82 being angled with respect to the transporting path 86 and the first end 54. Preferably the deflector 82 is at an included angle 98 which is between twenty and sixty degrees and, more preferably, the angle 98 is thirty degrees.

The depositing apparatus 74 of FIG. 4 results in more completely depositing all of the particles 64, and therefore reduces the quantity of the particles 64*p* which are able to escape from the depositing chamber 78 because of the accelerating and directing effects of the deflector 82 and the accelerating electrode 90.

Figure 5:
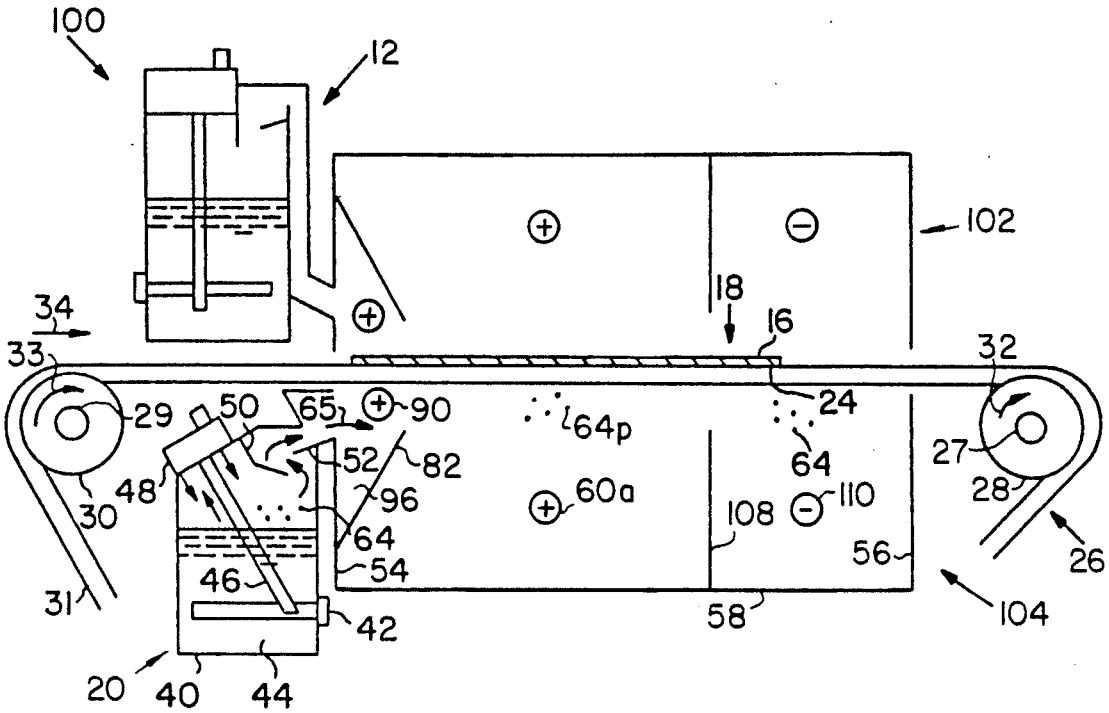
FIG. 5 is a cross-sectional elevation of a second embodiment of the present invention, and differs from the embodiment of FIG. 4 in that a baffle is interposed between the deflector and a second end of the depositing chamber, and a neutralizing electrode, which is energized at the opposite polarity from that of the depositing and accelerating electrodes, is inserted into the depositing chamber between the baffle and the second end of the depositing chamber.

Referring now to FIG. 5, a depositing apparatus 100 includes the particle generators 12 and 20, depositing chambers 102 and 104, and the transporting mechanism 26. The depositing chamber 104 includes the first end 54, the second end 56, and the deflector 82.

The construction of the depositing apparatus 100 of FIG. 5 differs from the depositing apparatus 80 of FIG. 4 in that: a baffle 108 is interposed between the deflector 82 and the second end 56, thereby defining a depositing chamber portion 104*a* having the depositing electrode 60*a* disposed therein and a neutralizing chamber portion 104*b* having a neutralizing electrode 110 interposed between the baffle 108 and the second end 56 of the depositing chamber 104.

In the depositing apparatus 74 of FIG. 4, as the sheet 18 is transported through the depositing chamber 22 in the direction of the arrow 34 and builds up a positive electrostatic charge as a result of the particles 64*p* with a positive charge being electrostatically deposited onto the sheet 18, there is a tendency for the smaller of the particles 64*p* to drift toward the second end 56 and to escape out of the depositing chamber 22, rather than being deposited onto the sheet 18.

However, in the depositing apparatus 100, whenever a small quantity of the positively-charged particles 64*p* are able to escape being electrostatically deposited onto the sheet 18, and drift past the baffle 108, they are recharged by the neutralizing electrode 110 to the opposite, or negative, potential. This negative charge on the neutralizing electrode 110 is indicated by a "−" sign on the neutralizing electrode 110.

Then, the negatively-charged particles 64*n* are strongly attracted to the sheet 18, which by now has a relatively large positive electrostatic charge on the bottom surface 24 thereof, even though the sheet 18 may be in contact with an electrical ground (not shown).

The results are that even this small quantity of the particles 64*n* are prevented from escaping past the second end 56 of the depositing chamber 104; and the depositing of the negatively-charged particles 64*n* results in a reduction of the residual electrostatic charge that accompanies electrostatic depositing and that often causes problems as enumerated earlier.

Figure 6:
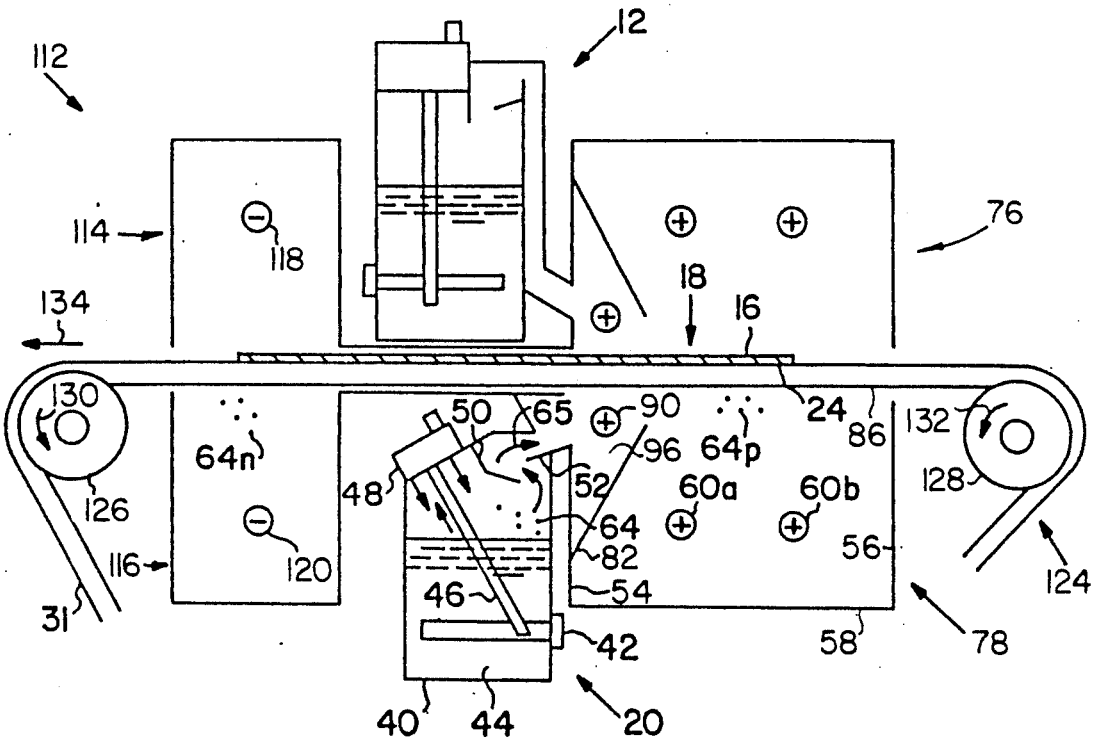
FIG. 6 is a cross-sectional elevation of a third embodiment of the present invention, and differs from the embodiment of FIG. 4 in that the direction of transport of the work pieces is reversed, and in that a separate neutralizing chamber effectively separates the neutralizing electrode from both the accelerating electrode and the depositing electrodes, and effectively separates positively-charged particles from negatively-charged particles.

Referring now to FIG. 6, in a third preferred embodiment of the present invention, a depositing apparatus 112 includes the particle generators 12 and 20, the depositing chambers 76 and 78, neutralizing chambers 114 and 116, neutralizing electrodes 118 and 120, and a transporting mechanism 124. The transporting mechanism 124 includes drive pulleys 126, driven pulleys 128, and the belts 31.

As shown by arrows 130, 132, and 134, the direction of rotation of the pulleys 126 and 128 and the direction of transport of the belts 31 are reversed from similar components of the embodiments of FIGS. 1, 4, and 5.

In operation, the accelerating electrode 90 cooperates with the accelerating and directing passageway 96 as described for FIG. 4, and the depositing electrodes 60*a* and 60*b* function as previously described in conjunction with the FIG. 4 embodiment.

However, with the direction of transport reversed, the aforementioned positive potential builds up as the sheet 18 approaches the neutralizing chamber 116; and if some particles 64*p* should not be deposited onto the sheet 18 because of the build-up of a positive potential on the sheet 18, then such particles would attempt to drift out of the depositing chamber 78 toward the neutralizing chamber 116 rather than toward the second end 56 of the depositing chamber 78. The reason for this is that, as the sheet 18 enters the depositing chamber 78 from the second end 56, there is no build up of potential on the sheet 18, so electrostatic depositing is completely efficient. But, as the sheet 18 builds up a positive potential, there may be some particles 64*p* that are not deposited.

The accelerating electrode 90 and the passageway 96 cooperate to direct the particles 64*p* toward the sheet 18, and so increase the efficiency of depositing in spite of the positive potential buildup on the sheet 18.

However, if some particles 64*p* do escape from the first end 54 of the depositing chamber 78, they are conducted into the neutralizing chamber 116 by a conduit 136.

The positively-charged particles 64*p* that escape from the depositing chamber 78, are conducted into the neutralizing chamber 116 by the conduit 136 where they are recharged to the negative potential by the neutralizing electrode 120.

Therefore, in the FIG. 6 embodiment, the deflector 82 cooperates with the first end 54 to form the passageway 96. The deflector 82 and the accelerating electrode 90 cooperate to draw particles 64 into and through the passageway 96, the accelerating electrode 90 accelerates entrance of the particles into the passageway 96, the accelerating electrode 90 charges the particles 64, and the accelerating electrode 90 and the passageway 96 cooperate to direct the particles 64 into depositing contact with the sheet 18.

In summary, the present invention provides means, comprising the accelerating electrode 90, for accelerating the entrance of particles 64 into the depositing chamber, 78 or 104, and means, comprising the passageway 96 and the deflector 82 thereof, for directing the particles 64 toward the sheet 18, thereby increasing the percentage of the particles 64*p* which are deposited onto the sheet 18, and thereby decreasing ecological contamination. The optional addition of a neutralizing electrode, 110 or 120, is effective both to improve the percentage of particles 64 that are deposited and to neutralize the residual electrostatic charge on the sheet 18; and the optional reversing of the direction of transport of the sheet 18 is additionally effective to improve the efficiency of particle deposition.

While specific apparatus and method have been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

INDUSTRIAL APPLICABILITY

The present invention is applicable to electrostatic depositing of various materials, particularly materials which may be aspirated. More particularly, the present invention is applicable to electrostatically depositing lubricants, such as petrolatum.

What is claimed is:

1. Electrostatic depositing apparatus, comprising a depositing chamber with first and second ends;

a depositing electrode disposed in said depositing chamber;

means for injecting particles of an electrostatically depositable material into said chamber proximal to said first end;

means for transporting a work piece through said depositing chamber;

means connected with said depositing electrode for electrostatically depositing said particles onto said work piece as said work piece is transported through said depositing chamber;

deflecting means comprising a deflector in said depositing chamber that is interposed between said first end and said depositing electrode, for mechanically directing said particles toward said work piece;

accelerating means comprising an accelerating electrode that is disposed generally between said first end and said deflector for electrostatically directing said particles toward said work piece; and means for electrostatically neutralizing said work piece subsequent to electrostatically depositing said particles thereupon.

2. Apparatus as claimed in claim 18 in which said means for transporting said work piece comprises means for transporting said work piece along a predetermined transporting path;

said depositing electrode is disposed at a first distance from said transporting path; and said accelerating electrode is disposed at a closer distance to said transporting path than said depositing electrode.

3. Apparatus as claimed in claim 1 in which said means for transporting said work piece comprises means for transporting said work piece along a predetermined transporting path;

said deflector includes an outer edge, and an inner edge that is closer to said work piece than said outer edge; and said inner edge is disposed closer to said second end of said depositing chamber than said outer edge thereof.

4. Apparatus as claimed in claim 1 in which said means for transporting said work piece comprises means for transporting said work piece along a predetermined transporting path; and said deflector includes an outer edge, and an inner edge that is closer to said work piece than said outer edge, said deflector being angled toward said second end of said depositing chamber at an included angle of between twenty and sixty degrees with respect to the vertical so that said inner edge of said deflector is closer to said second end of the depositing chamber than is said outer edge.

5. Apparatus as claimed in claim 1 in which said means for depositing said particles comprises means for energizing said depositing electrode to a first polarity; and said accelerating means comprises means for energizing said accelerating electrode to said first polarity.

6. Apparatus as claimed in claim 1 in which said means for transporting said work piece comprises mens for transporting said work piece along a predetermined transporting path;

said depositing electrode is disposed at a first distance from said transporting path;

said accelerating electrode is disposed at a closer distance to said transporting path than said depositing electrode;

said deflector includes an outer edge, and an inner edge that is closer to said work piece than said outer edge;

said deflector is angled toward said second end of said depositing chamber at an included angle of between twenty and sixty degrees with respect to the vertical so that said inner edge of said deflector is closer to said second end of the depositing chamber than is said outer edge;

said means for depositing said particles comprises means for energizing said depositing electrode to a first polarity; and said accelerating means comprises means for energizing said accelerating electrode to said first polarity.

7. Apparatus as claimed in claim 1 in which said means for electrostatically depositing comprises means for energizing said depositing electrode to a first polarity;

said means for accelerating comprises means for energizing said accelerating electrode to said first polarity; and said means for neutralizing comprises a neutralizing electrode and means for energizing said neutralizing electrode to the opposite polarity.

8. Apparatus as claimed in claim 7 in which said apparatus comprises baffle means disposed between said neutralizing electrode and said depositing electrode, said baffle means defining a first depositing chamber portion having said accelerating and depositing electrodes disposed therein and a second neutralizing chamber portion having said neutralizing electrode disposed therein.

9. Apparatus as claimed in claim 7 in which said apparatus further comprises a neutralizing chamber that is separate from said depositing chamber, and wherein said neutralizing electrode is disposed in said neutralizing chamber.

10. Apparatus as claimed in claim 1 in which said means for transporting said work piece through said depositing chamber comprises means for transporting said work piece from outside of the depositing chamber into said first end of said depositing chamber.

11. Apparatus as claimed in claim 1 in which said means for transporting said work piece through said depositing chamber comprises means for transporting said work piece from outside of the depositing chamber into said second end of said depositing chamber.

12. A method for electrostatically depositing particles onto a work piece, comprising injecting particles for deposition into a depositing chamber;

mechanically deflecting said injected particles to direct said particles toward said work piece;

providing an accelerating electrode adjacent the deflected particles;

charging the accelerating electrode to a first polarity to electrostatically charge and direct the deflected particles toward said work piece;

providing a depositing electrode in said depositing chamber;

charging said depositing electrode to said first polarity to electrostatically charge and direct said particles for deposition on said work piece in said depositing chamber; and electrostatically neutralizing said work piece after electrostatic deposition of said particles.

13. A method as claimed in claim 12 in which said injecting step comprises injecting said particles into a deflecting chamber portion of said deposition chamber; and said electrostatic charging and directing step comprises electrostatically charging some of said particles in said deflecting chamber portion.

14. A method as claimed in claim 12 in which said electrostatic depositing step comprises:

a. depositing a portion of said injected particles while said particles are in a deflecting chamber portion of said depositing chamber;

b. transporting the undeposited portion of said particles to the remainder of said depositing chamber; and c. depositing said undeposited portion of said particles after said transporting step.

15. The method of claim 12 wherein said step of electrostatically neutralizing said work piece comprises providing a neutralizing electrode and charging the neutralizing electrode to the polarity opposite to the voltage charging the accelerating and depositing electrodes.

16. The method of claim 15 wherein said neutralizing electrode is provided in a separate neutralizing chamber.

17. The method of claim 15 wherein baffle means is provided to separate said depositing chamber into a depositing portion and a neutralizing portion, and said accelerating and depositing electrodes are provided in said depositing portion and said neutralizing electrode is provided in said neutralizing portion.

* * * * *

UNITED STATES PATENT AND TRADEMARK OFFICE

CERTIFICATE OF CORRECTION

PATENT NO :5,045,343

DATED : September 3, 1991
INVENTOR(S) :Joseph B. Lamirand, et. al.

It is certified that error appears in the above-identified patent and that said Letters Patent is hereby corrected as shown below:

In column 9, line 22, delete "18", and insert therefor --1--.

In the drawings consisting of Figs. 5 and 6 should be deleted and be replaced with Figs. 5 and 6 as shown on per attached sheets.

Signed and Sealed this

Twentieth Day of December, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO :5,045,343

DATED :September 3, 1991

INVENTOR(S) :Joseph B, Lamirand, et. al.

It is certified that error appears in the above-identified patent and that said Letters Patent is hereby corrected as shown below:

FIG. 5

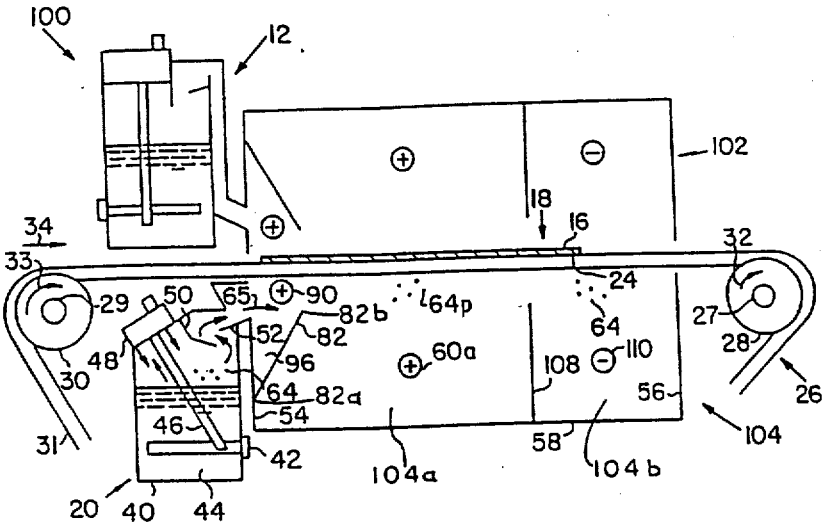

UNITED STATES PATENT AND TRADEMARK OFFICE

CERTIFICATE OF CORRECTION

PATENT NO :5,045,343

DATED :September 3, 1991

INVENTOR(S) :Joseph B, Lamirand, et. al.

It is certified that error appears in the above-identified patent and that said Letters Patent is hereby corrected as shown below:

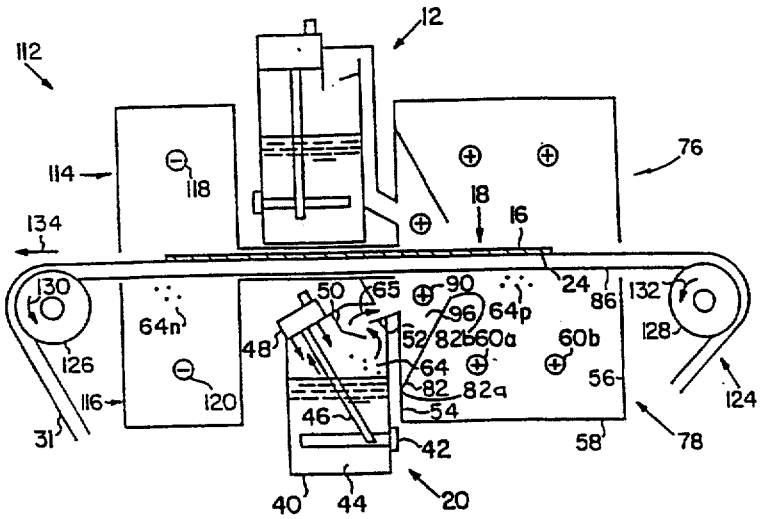

FIG. 6